US006479942B2

(12) United States Patent
Kimura

(10) Patent No.: US 6,479,942 B2
(45) Date of Patent: Nov. 12, 2002

(54) LIGHT EMISSION UNIT

(75) Inventor: Tsutomu Kimura, Saitama (JP)

(73) Assignee: Fuji Photo Optical Co., Ltd., Saitama (JP)

( * ) Notice: Subject to any disclaimer, the term of this patent is extended or adjusted under 35 U.S.C. 154(b) by 0 days.

(21) Appl. No.: 09/825,306

(22) Filed: Apr. 4, 2001

(65) Prior Publication Data

US 2001/0028223 A1 Oct. 11, 2001

(30) Foreign Application Priority Data

Apr. 5, 2000 (JP) ..... 2000-103506

(51) Int. Cl.[7] ..... G09G 3/10
(52) U.S. Cl. ..... 315/169.3; 396/322; 362/800
(58) Field of Search ..... 315/169.3, 169.4, 315/169.1; 396/322, 547; 362/800

(56) References Cited

U.S. PATENT DOCUMENTS 5,917,280 A * 6/1999 Burrows et al. ..... 313/506
5,998,803 A * 12/1999 Forrest et al. ..... 257/40
6,219,074 B1 * 4/2001 Chosa et al. ..... 347/130

FOREIGN PATENT DOCUMENTS

JP 11-344772 12/1999
JP 2000-305191 11/2000

* cited by examiner

*Primary Examiner*—Don Wong
*Assistant Examiner*—Tuyet T. Vo
(74) *Attorney, Agent, or Firm*—Young & Thompson

(57) ABSTRACT

A light emission device includes organic light emission element arrays for red, green and blue, each of which has a plurality of microscopic organic light emission elements arranged in line. Three-color recording light beams of one line emitted from said organic light emission element arrays are applied to an instant photo film through corresponding condenser lenses and graded-index type optical fiber. The condenser lenses are formed integrally with a surface of a transparent plate, on the other side of which the organic light emission element arrays for red, green and blue are stacked. In order to correct axial chromatic aberration, radius of curvature of each condenser lens is varied in accordance with the color of light beam emitted from corresponding organic light emission element.

18 Claims, 9 Drawing Sheets

LIGHT EMISSION UNIT

FIELD OF THE INVENTION

The invention relates to a light emission unit for emitting plural linear light beams of different color, which has a plurality of light emission element arrays for emitting a linear light beam of same color.

BACKGROUND OF THE INVENTION

A color printer for recording a full-color image to an instant photo film as a recording material is disclosed in JPA No. 11-377442 and so forth. The color printer has an exposure head for emitting red, green and blue recording light beams toward the instant photo film. The exposure head includes red, green and blue light emission element arrays, each of which has a plurality of light emission elements arranged linearly along the direction perpendicular to the feeding direction of the instant photo film. By use of this exposure head, three color synchronous recording or three color line sequential recording is carried out for recording a full-color image. As the light emission element, an organic light emission element may be used as well as a light emitting diode (LED). The organic light emission element is well-known by "Separate Volume of November issue of The Monthly Display (published by TECHNO TIMES CO., LTD.)" and so forth.

The organic light emission element has a transparent substrate and a dielectric mirror, transparent positive electrode, at least one organic compound layer, and a negative electrode which are stacked on the transparent substrate in this order listed. Recording light beams, generated in the organic compound layer, are reflected by the negative electrode, so the light beams are emanated from the transparent substrate through the positive electrode. In the organic light emission element, recording light beams are resonated in a micro cavity between the dielectric mirror and the negative electrode, so it is possible to have bright light, the half width of the spectrum of which is extremely narrow.

For three color synchronous recording or three color line sequential recording by use of the organic light emission elements, red, green and blue light emission element arrays are arranged parallel to one another. In respective light emission element arrays, a plurality of organic light emission elements for emitting light beam of same color for each pixel are arranged in line.

In front of the light emission element arrays is disposed a focusing lens array, which is comprised of a plurality of microscopic focusing lens arranged in line. Recording light beams from the light emission element arrays are focused on the instant photo film through the focusing lens. The focusing lens may be configured such that linear recording light beams of three color are focused on the same line of the instant film, or on different lines that are parallel to one another.

The light emission element arrays of LED type is configured by mounting LED arrays of three-color on a substrate. Each LED array has a plurality of LEDs for emitting recording light beams of same color arranged in line. Recording light beams from the LED array are focused on the instant film through the focusing lens array in the same way as above.

In order to keep the light emission surface from a dust or flaw, it is preferable to secure a transparent cover plate on the light emission surface. The light emission element arrays and the cover plate, which comprise a light emission array unit, and the focusing lens array are incorporated in the exposure head.

For effective utilization of recording light beams, the incident surface of the focusing lens array is required to be located close to the light emission element array, such that the angular aperture is increased. However, the transparent substrate and the cover plate are provided between the light emission element array and the focusing lens array. Thus, because of the difficulty to shorten the distance between the incident surface and the emission surface, it is hard to increase utilization efficiency of the emitted light beams from the light emission element arrays.

In order to utilize recording light beams, a condenser lens array can be disposed between the light emission array unit and the focusing lens array. In that case, however, parts number of the exposure head is increased for providing the condenser lens array, so manufacturing cost is also increased. Furthermore, in order to adjust the optical axis of each condenser lens so as not to be inclined against to the optical axis of corresponding focusing lens, the condenser lens array must be positioned with high accuracy. This increases the manufacturing cost of the exposure head.

SUMMARY OF THE INVENTION

The present invention is to provide a light emission unit for emitting linear light beams of full-color, in which a focusing lens array is disposed close to an emission surface of light emission element arrays without increasing manufacturing cost.

To achieve the above objects, a light emission unit of the present invention comprises a plurality of light emission element arrays for emitting a plurality of linear light beams of different color from a light emitting surface, a transparent plate for protecting the light emitting surface, and a plurality of lens arrays integrated with the transparent plate such that each of the lens arrays corresponds to each of the light emission element arrays. Each of the light emission arrays includes a plurality of light emission elements arranged in line for emitting light beam of same color. In addition, respective lens array includes a plurality of condenser lenses faced to respective light emission elements.

In the embodiment, the light emission unit is used for printer for exposing an image to a photosensitive material. The light emission element array includes a transparent positive electrode, an organic compound layer, a negative electrode, which are stacked on the transparent layer in this order listed. The organic compound layer includes organic light emission element arrays for red, green and blue for emitting linear light beam of red, green and blue respectively.

The radius of curvature of the condenser lens becomes smaller as the wavelength of light beam of corresponding light emission element becomes longer, such that red, green and blue light beams are focused on the photosensitive material without causing axial chromatic aberration. The light emission element arrays of red, green and blue are arranged in this order. The condenser lenses for red band blue are located such that their optical axes are not coincident with optical axes of corresponding light emission elements, but slightly shifted toward the condenser lens for green. Thereby, red and blue light beams are inclined toward the green light beam, such that linear light beams of three color are focused on the same line of the photosensitive material.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE INVENTION

Figure 1:
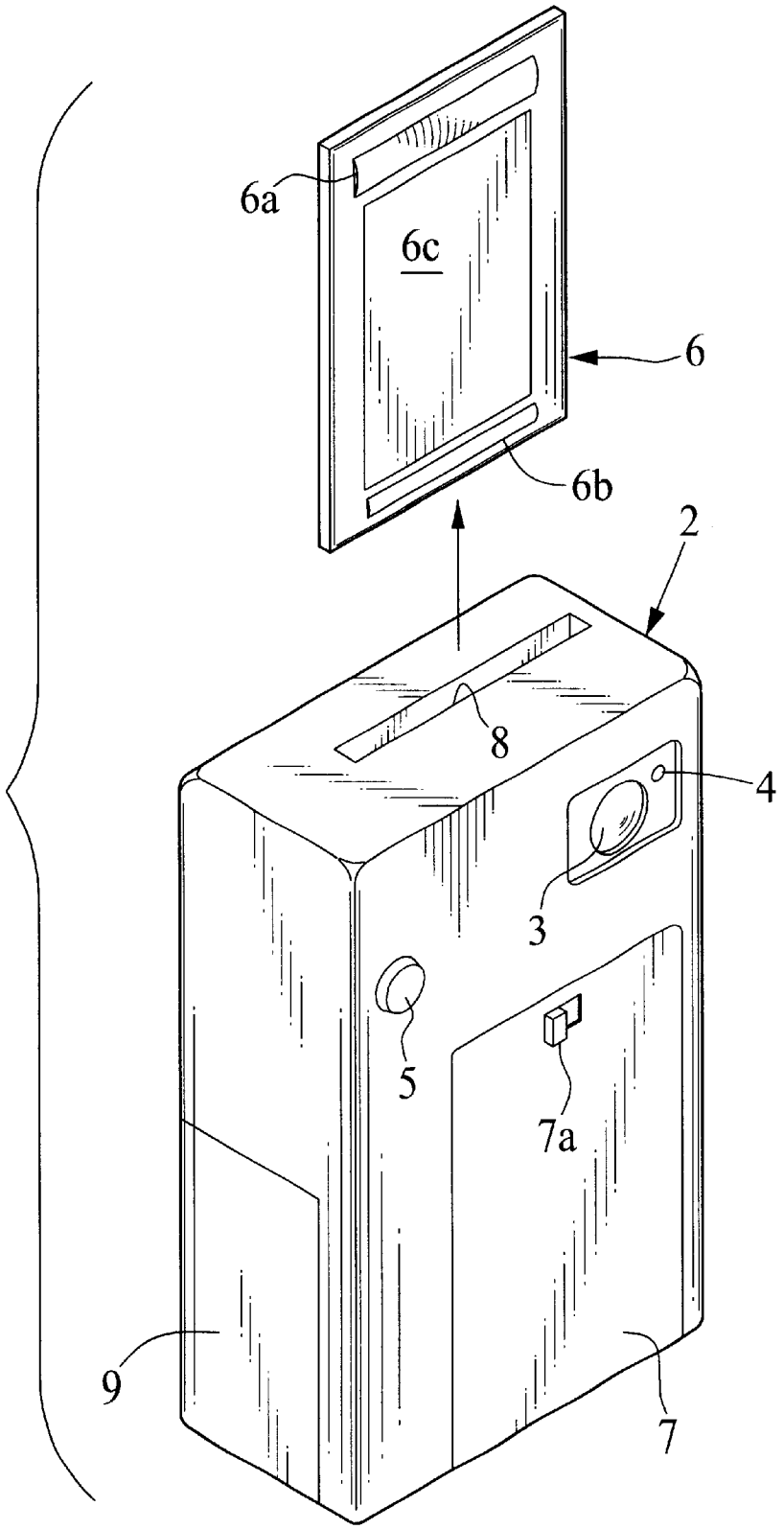
FIG. 1 is a front perspective view of an electronic still camera having a light emission unit of the present invention.

FIG. 1 shows a perspective view of an electronic still camera, in which a light emission unit of the present invention is incorporated. A taking lens 3, a photometry window 4, a shutter release button 5 and a pack loading door 7 are provided on a front side of a camera body 2. Behind the taking lens 3 is disposed a CCD (Charge Coupled Device) image sensor on which an optical subject image is focused. Behind the photometry window 4, a photo sensor is disposed for measuring subject brightness. Upon being depressed a shutter release button 5, optical subject image is taken by the CCD image sensor, and is converted into electrical image signal.

The pack loading door 7 is rotatably attached to the camera body 2, and is usually locked in a closed position for covering a pack loading chamber, as shown in FIG. 1. When a knob 7*a* is operated, the pack loading door 7 is released to open the pack loading chamber. In the pack loading chamber is loaded a film pack, in which about ten sheets of instant photo films 6 as recording materials are stacked.

The instant film 6 is on the market as known mono-sheet type for an instant camera, and includes a photosensitive sheet, image receiving sheet, processing fluid pod 6*a* and a surplus fluid accepting portion 6*b*. By application of light beams to an exposure surface 6*c* of the instant film 6, a latent image is formed in the photosensitive sheet. Thereafter, by pressing the image receiving sheet to the photosensitive sheet while extending processing fluid in the processing fluid pod 6*a* over the whole exposure area of the instant photo film 6, a positive image is transferred to the image receiving sheet, so that the positive image is appeared in the surface opposite to the exposure surface 6*c*.

An ejection slit 8 is formed through a top side of the camera body 2. After recording operation, an exposed instant film 6 is ejected through the ejection slit 8. A lid 9 is rotatably attached to a side wall of the camera body 2, for opening or closing a battery loading chamber and a memory slot. A battery as a power source of the camera is loaded in the battery loading chamber. Image data is usually stored in an internal flash memory, but it may be stored in a memory card as an external memory loaded in the memory slot.

Figure 2:
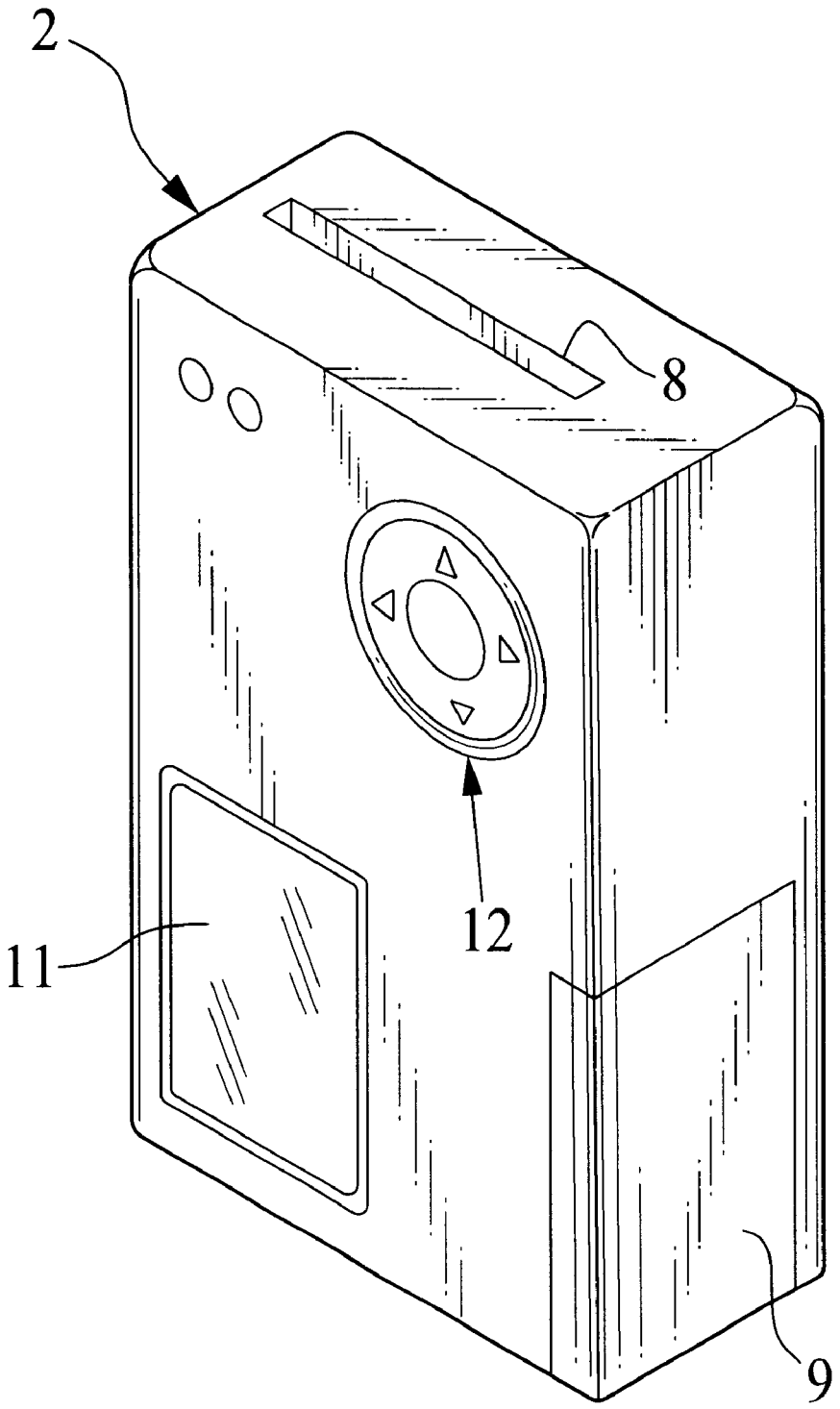
FIG. 2 is a rear perspective view of the electronic still camera of FIG. 1.

As shown in FIG. 2, an LCD (liquid crystal display) panel 11, console panel 12 including a main switch and so forth are provided in a rear side of the camera body 2. The LCD panel 11 constitutes an electronic viewfinder for displaying images of subjects as being photographed through the taking lens 3 in a real time fashion, and is used for reproducing image data stored in internal or external memory. By operating the console panel 12, it is possible to choose operation mode of the camera, select images to print, enter a print command, delete image data and carry out other operations. The operation mode is selectable between a taking mode for taking subjects, a reproduction mode for reproducing images in the LCD panel 11, and a taking-and-printing mode for printing an image just after taking operation.

Figure 3:
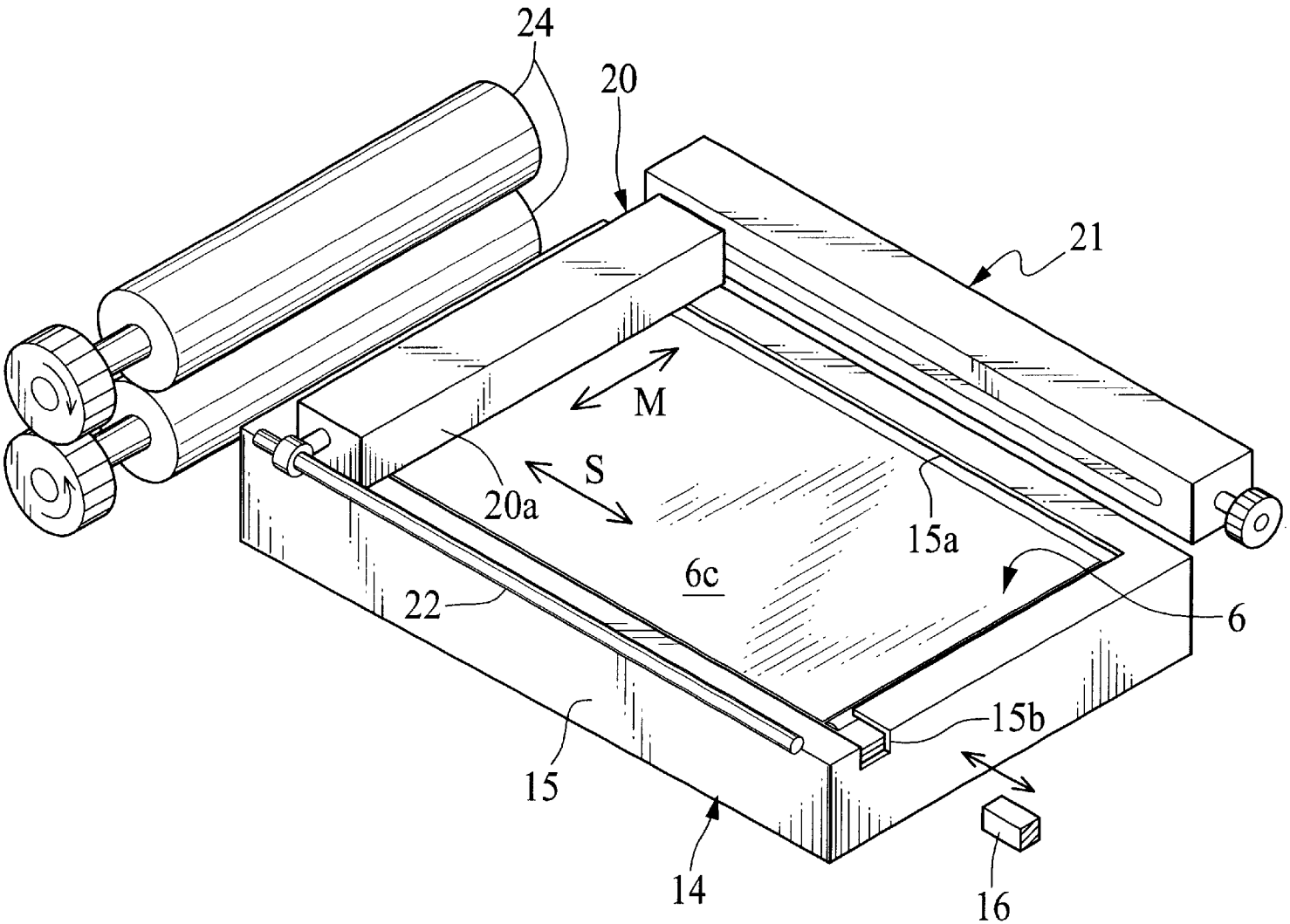
FIG. 3 is a perspective view of a printing device and a film pack.

FIG. 3 shows a printing device and a film pack 14 loaded in the electronic still camera. The film pack 14 is comprised of a pack case 15 and about ten sheets of instant photo films 6 contained in the pack case 15. The pack case 15 has an exposure opening 15*a*, a cutout 15*b* and a slit for advancing the instant photo film 6. The instant photo film 6 is contained in the pack case 15 with the exposure surface 6*c* faced to the exposure opening 15*a*. Recording light beams are applied to the instant film 6 through the exposure opening 15*a*. When an exposure is completed, a claw member 16 is moved inside the pack case 15 through the cutout 15*b*, to advance an exposed instant film 6 out of the pack case 15.

The print device is comprised of an exposure head 20, a head moving mechanism 21, an ejection mechanism and so on, all of which are disposed in the pack loading chamber. The exposure head 20 is located such that a head body 20*a* extends along a main scan direction (direction of the arrow M) that is perpendicular to the sub scan direction (direction of the arrow S) to advance the instant film 6.

One end of the exposure head 20 is secured to a lead screw of the head moving mechanism 21, and the other end is slidably attached to the guide rod 22 that is extended parallel to the sub scan direction S. The head moving mechanism 21 has a scanning motor 23 (See FIG. 9) for rotating the lead screw to slide the exposure head 20 in the sub scan direction S. When a print command is entered, the exposure head 20 moves line by line from a print start position, shown in FIG. 3, to face the one end portion of the instant photo film 6. When the exposure head reaches to a print end position to face the other end portion of the instant photo film 6, printing operation is completed. While being conveyed in the sub scan direction S, red, green and blue recording light beams are emitted from the exposure head 20, and synchronously applied to the instant photo film 6 to record a full-color image line by line.

The ejection mechanism is comprised of a claw mechanism for moving the claw member 16, a spread roller set 24 and so forth. The claw member 16 and the spread roller set 24 is driven by a ejection motor 25 (See FIG. 9). After exposure, the claw member 16 inserts into the pack case 15 through the cutout 15*b* to push the rear end of an exposed instant film 6 to feed it toward the spread roller set 24. The spread roller set 24 rotates for advancing an exposed instant photo film 6 to outside of the camera body 2 through the ejection slit 8. The instant photo film 6 passes the spread roller set 24 from the side of the processing fluid pod 6*a*, which is pressed to be ruptured by the spread roller set 24 to spread the processing fluid inside the instant photo film 6. In feeding, the instant photo film 6 is pressed by the spread roller set 24, so the photosensitive sheet and the image receiving sheet are tightly pressed to each other. Accordingly, an image is transferred to the image receiving sheet. The function of the ejection mechanism is the same as that of the conventional instant camera, so its configuration may be the same as the conventional one.

Figure 4:
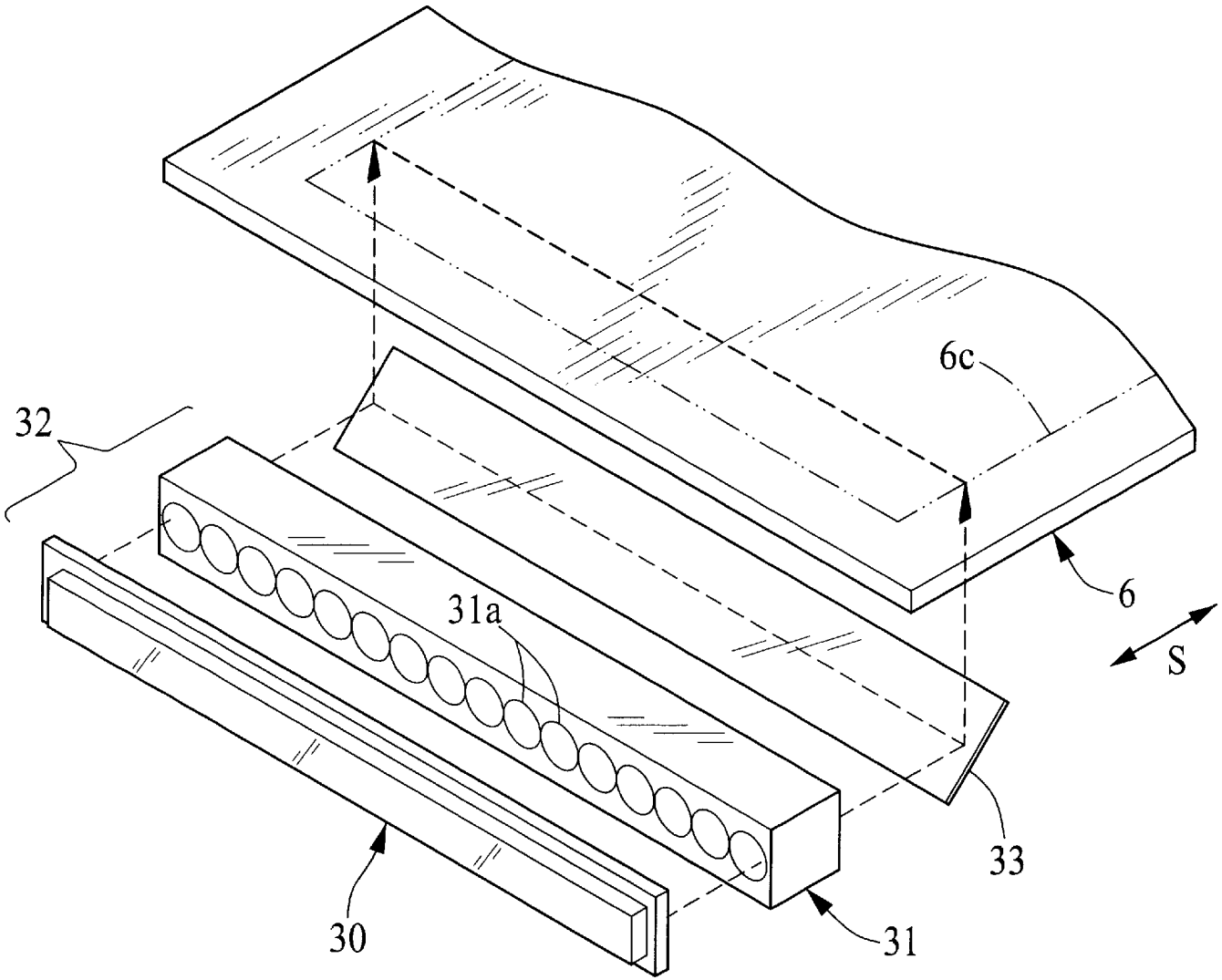
FIG. 4 is an exploded perspective view of an exposure head.

As shown in FIG. 4, the exposure head 20 is comprised of a light emission unit 32 and a mirror 33, which are contained in the head body 20*a*. The light emission unit 32 has a light emission array unit 30 and a focusing lens array 31. The light emission array unit 30 emanates red, green and blue recording light beams of one line, each of which is extended parallel to the main scan direction M. The recording light beams are projected to the mirror 33 through the focusing lens array 31, and reflected by the mirror 33. Then, the optical light paths are bent toward the instant photo film 6, and recording light beams are applied thereto. The recording light beams may be directly applied to the instant photo film 6 without bending their optical light paths. In this figure, the head body 20*a* and a housing 35 for containing the light emission array unit 30 and the focusing lens array 31 are omitted.

Figure 5:
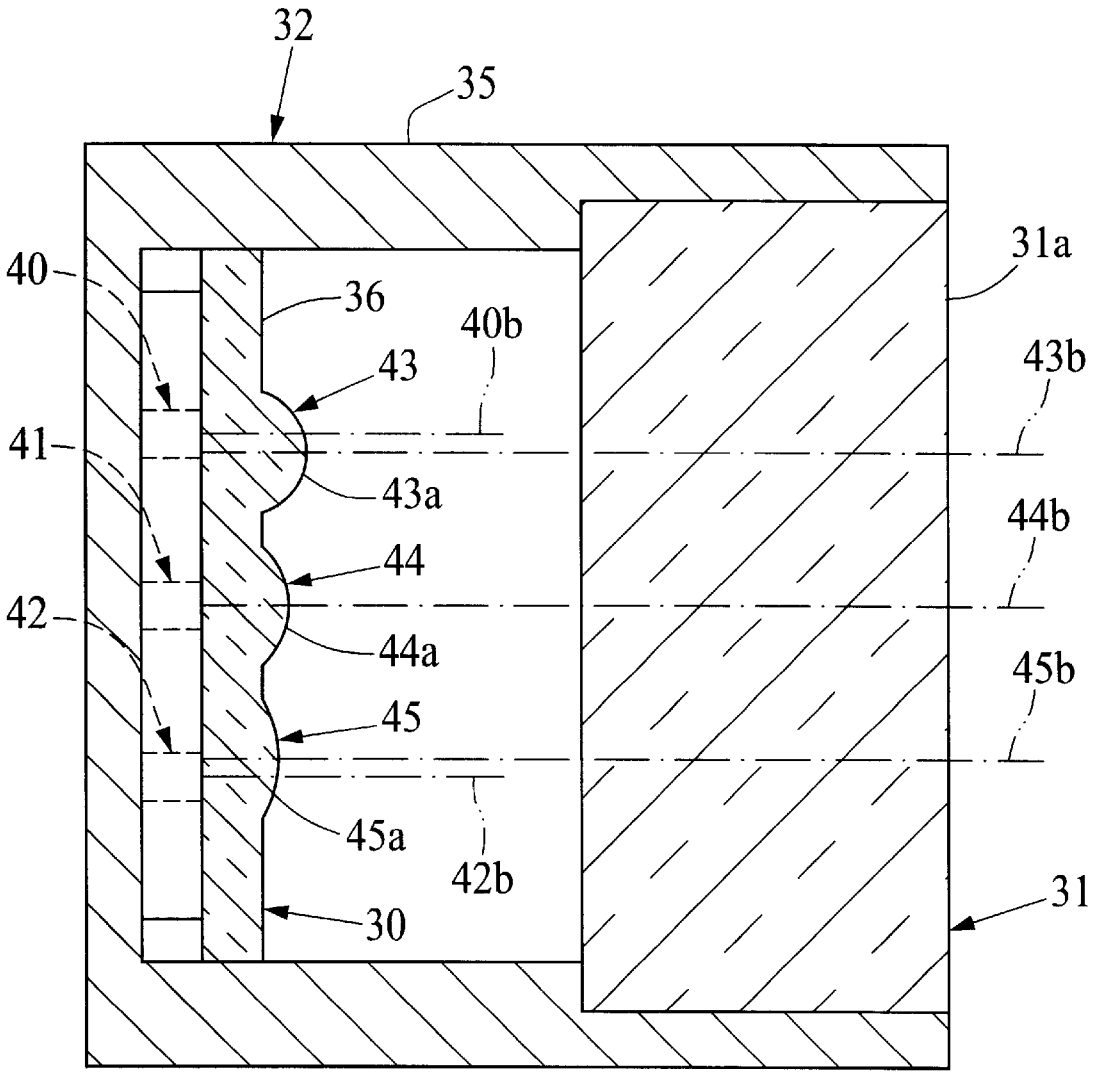
FIG. 5 is a sectional view of the light emission unit.

As shown in FIG. 5, the light emission array unit 30 and the focusing lens array 31 are assembled in the housing 35. The light emission array unit 30 has a transparent plate 36 and an organic light emission array for red 41, an organic light emission array for green 42 and an organic light emission array for blue 43, which are provided on a rear side of the transparent plate 36. The organic light emission array for red, green and blue 41 to 43 emit linear recording light beams of red, green and blue respectively. A lens array for red 43, a lens array for green 44 and a lens array for blue 45 are integrated with the transparent plate 36, and each of them is positioned in front of corresponding organic light emission array.

Figure 6:
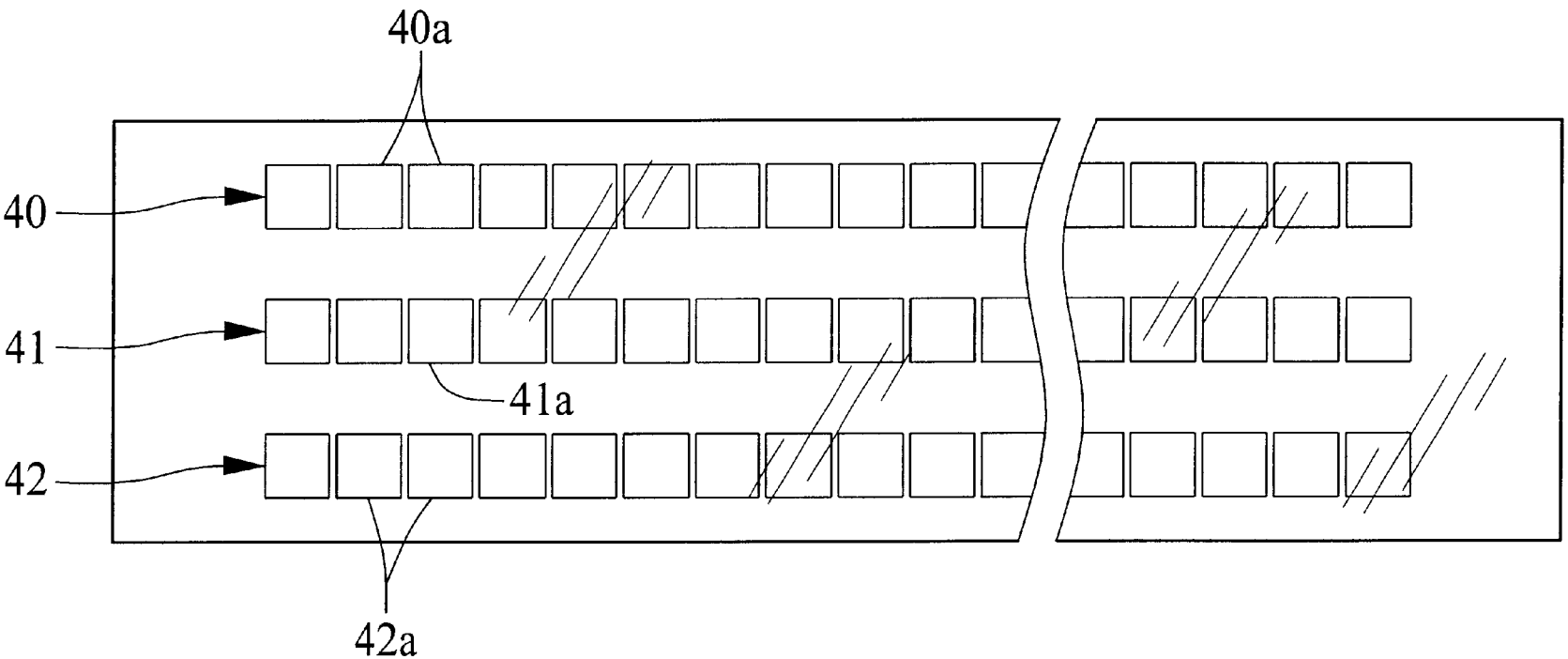
FIG. 6 is a planer view of the light emission unit.

In FIG. 6, each of the organic light emission element arrays 40 to 42 have a plurality of microscopic organic light emission elements 40*a* to 42*a* for emitting red, green and blue recording light beams respectively. The organic light emission elements for emitting the light beam of same color are arranged in line parallel to the main scan direction M at certain intervals. Recording light beams of three color are emitted through the transparent plate 36. Each organic light emission element corresponds to one pixel of the print image, and is controlled its light emitting time according to the gradation of a print image. In this figure, the transparent plate 36 is omitted.

In the embodiment, the organic light emission element has a rectangular shape the side of which has a length of about 100 $\mu$m, but it may be a circular shape. In this embodiment, the organic light emission arrays is comprised of 480 organic light emission elements, but the number of the organic light emission elements may be varied according to the purpose or quality of image to print.

Figure 7:
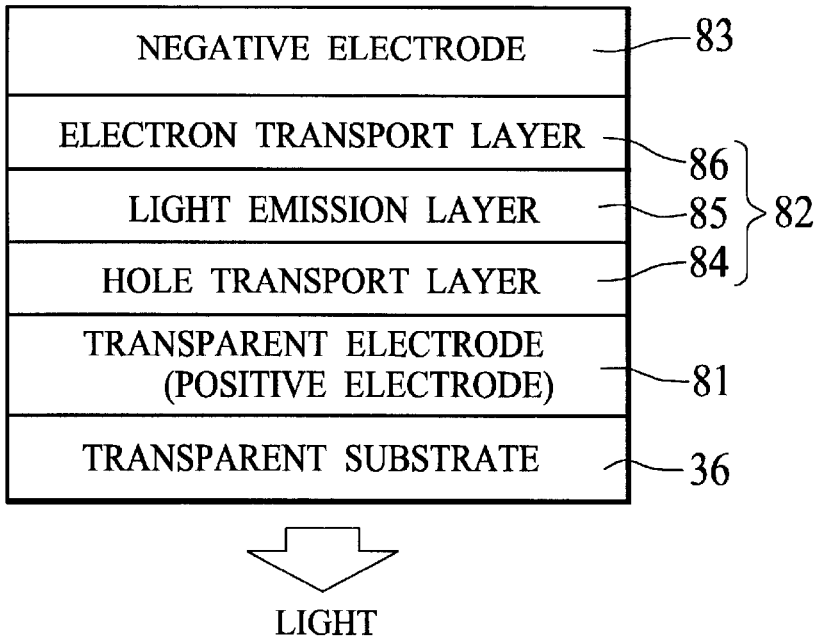
FIG. 7 is an explanatory view of an example of the structure of an organic light emission element.

As shown in FIG. 7, the organic light emission element has a transparent positive electrode 81, an organic compound layer 82 and a negative electrode 83 as a metal mirror, which are stacked on a transparent plate 36 as a substrate in this order listed. As the transparent plate 36, glass or plastic may be applicable. Recording light beam is generated in the organic compound layer 82, and is emitted through the transparent substrate 36. As the transparent electrode 81, tin oxide, indium tin oxide, indium zinc oxide and so on are applicable.

Configuration and elements of the organic layer 82 and the negative electrode 83 may be changed in accordance with the color of recording light beam. The negative electrode 83 is formed by stacking silver or aluminum layer on magnesium-aluminum composite or calcium layer, for example. The organic compound layer includes a hole transport layer 84, a light emission layer 85 and an electron transport layer 86, which are stacked in this order listed. It may be possible to have plural light emission layers 85. In addition, it may be possible to have a hole injection layer and an electron injection layer. The configuration and element of the organic light emission element shown in this figure is one example, so they may be varied according to the purpose of the printing device.

Figure 8:
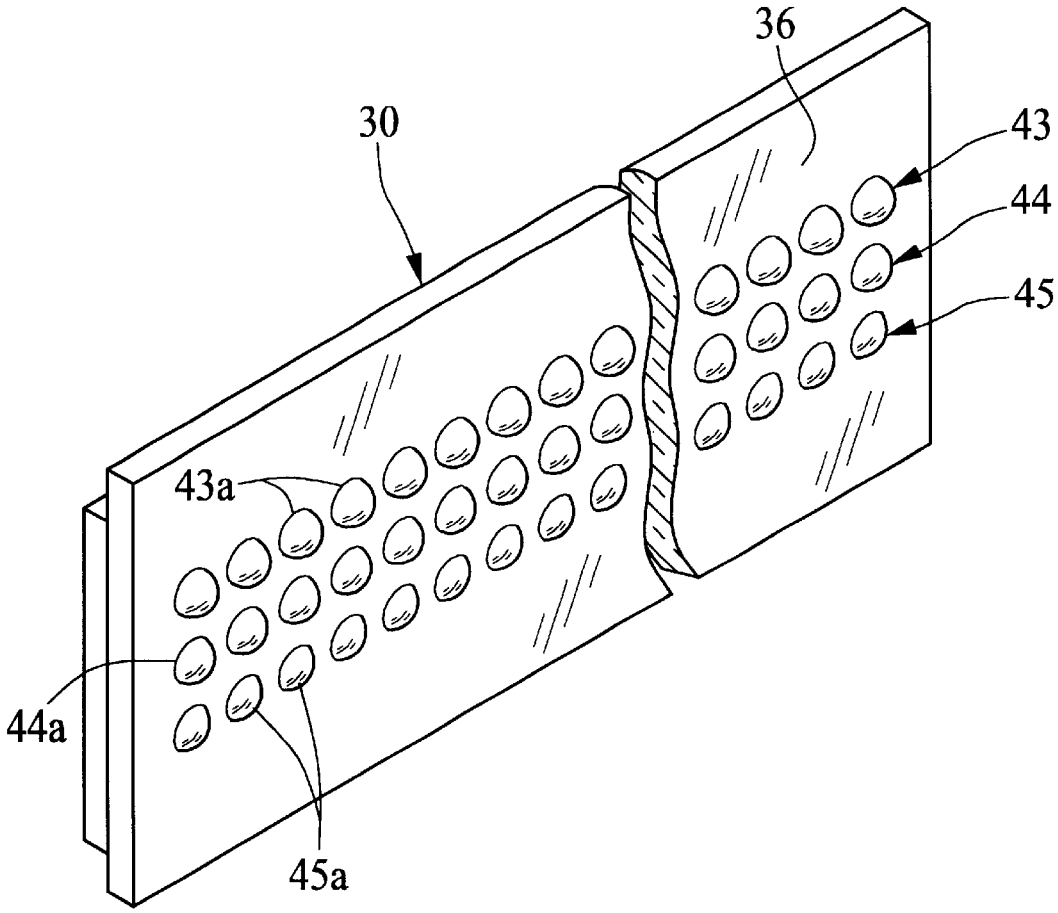
FIG. 8 is a perspective view of a light emission array unit having lens arrays.

In FIG. 8, the lens array for red 43 has a plurality of microscopic condenser lenses for red 43*a* arranged in line parallel to the main scan direction M. Each condenser lens for red 43*a* is positioned in front of each organic light emission element for red 40*a*. Red recording light beam from the light emission element 40*a* is emanated toward the focusing lens array 31*a* through the corresponding condenser lens 43*a*. The lens array for green 44 has a plurality of microscopic condenser lenses for green 44*a* arranged in line, and green recording light beams from the organic light emission elements 41*a* are emanated through corresponding condenser lenses 44*a*. In the same way, the lens array for blue 45 has a plurality of microscopic condenser lenses for blue 45*a*, through which blue recording light beams from the light emission elements 42*a* are emanated.

In FIG. 4, the focusing lens array 31 is comprised of a plurality graded-index type optical fibers 31*a* (so-called as "selfoc lens" (trade name)) arranged in line parallel to the main scan direction M. As shown in FIG. 5, one distal end of each graded-type optical fiber 31*a* (hereinafter referred to as optical fiber) is faced to the condenser lenses 43*a* to 45*a*. Recording light beams of three color, emanated through condenser lenses of at least one pixel, enter the corresponding optical fiber 31*a*.

In the embodiment, number of the optical fibers 31*a* is smaller than that of the condenser lenses of each color, so recording light beams through several condenser lenses 43*a* to 45 enter one optical fiber 31*a*. It is possible to assign one optical fiber 31 to condenser lenses 43*a* to 45*a* of one pixel. In addition, normal lenses may be substituted for the optical fibers 31*a*.

Recording light beams of red, green and blue are focused on the instant photo film 6 through the optical fibers 31*a*. Thereby, three-color recording light beams of one line are respectively applied to the instant photo film 6.

The condenser lens for green 44*a* is located such that its optical axis 44*b* is coincident with the optical axis of the organic light emission element for green 41*a*. On the other hand, the condenser lenses for red and blue 43*a* and 45*a*, which are arranged above and below the condenser lens for green 44*a*, are located such that their optical axes 43*b* and 45*b* are not coincident with optical axes of corresponding light emission elements 40*b* and 42*b*, but they are slightly shifted toward the optical axis for green 44*b*. Thereby, the blue and red recording light beams from the organic light emission elements 40*a* and 42*a* are inclined toward the optical axis for green 44*b*, so that three color recording light beams of one pixel are focused on the same position of the instant photo film 6 through the focusing lens array 31. Accordingly, linear recording light beams of three color from the light emission unit 32 are applied to the instant photo film 6 as recording light beam of one line along the main scan direction M.

The condenser lenses 43*a* to 45*a* have functions to focus recording light beams on the instant photo film 6 in cooperation with the optical fibers 31*a,* and to condense recording light beams projected from the light emission element arrays 40 to 42 effectively and have them enter the optical fibers 31*a.* The condenser lenses 43*a* to 45*a* are positioned sufficiently close to the organic light emission elements 40*a* to 42*a,* so their angular apertures are increased. Thereby, most of recording light beams from the light emission unit 32 are condensed in the condenser lenses 43*a* to 45*a,* and then enter the optical fibers 31*a.*

The optical fiber 31*a* has such a characteristic that focal point of red light beam is further than that of green light beam, and focal point of blue light beam is nearer than that of green light beam. Thus, axial chromatic aberration is caused, in the same way as a spherical lens. In order to correct this chromatic aberration, radii of curvature of lenses 43*a* to 45*a* are varied according to the wavelength of light beam from corresponding light emission element. That is, the radius of curvature is enlarged as wavelengths of corresponding light beam shortens.

For instance, radius of curvature of condenser lens for red 43*a* is determined properly as R1 such that red recording light beam through the condenser lens 43*a* is focused on the instant photo film 6. Then, radius of curvature of condenser lens for green 44*a* is determined as R2, larger than R1, such that recording light beam through the condenser lens 44*a* is focused on the same position of the instant photo film 6 as the red recording light beam. In the same way, radius of curvature of condenser lens for blue 45*a* is determined as R3, larger than R2, such that blue recording light beam through the condenser lens 45*a* is focused on the same position.

Radii of curvature of three kinds of condenser lenses 43*a* to 45*a* are determined in consideration of wavelength of corresponding light beam from light emission elements 40*a* to 42*a,* diffractive index of the transparent plate 36, optical characteristic of optical fibers 31*a* and so on.

The condenser lenses 43*a* to 45*a* having such functions described above are integrated with the transparent plate 36 as the substrate of the light emission element array, so the parts number is not increased. Moreover, it is not necessary to adjust their optical axes. Accordingly, it is possible to utilize recording light beams without increasing manufacturing cost.

Figure 9:
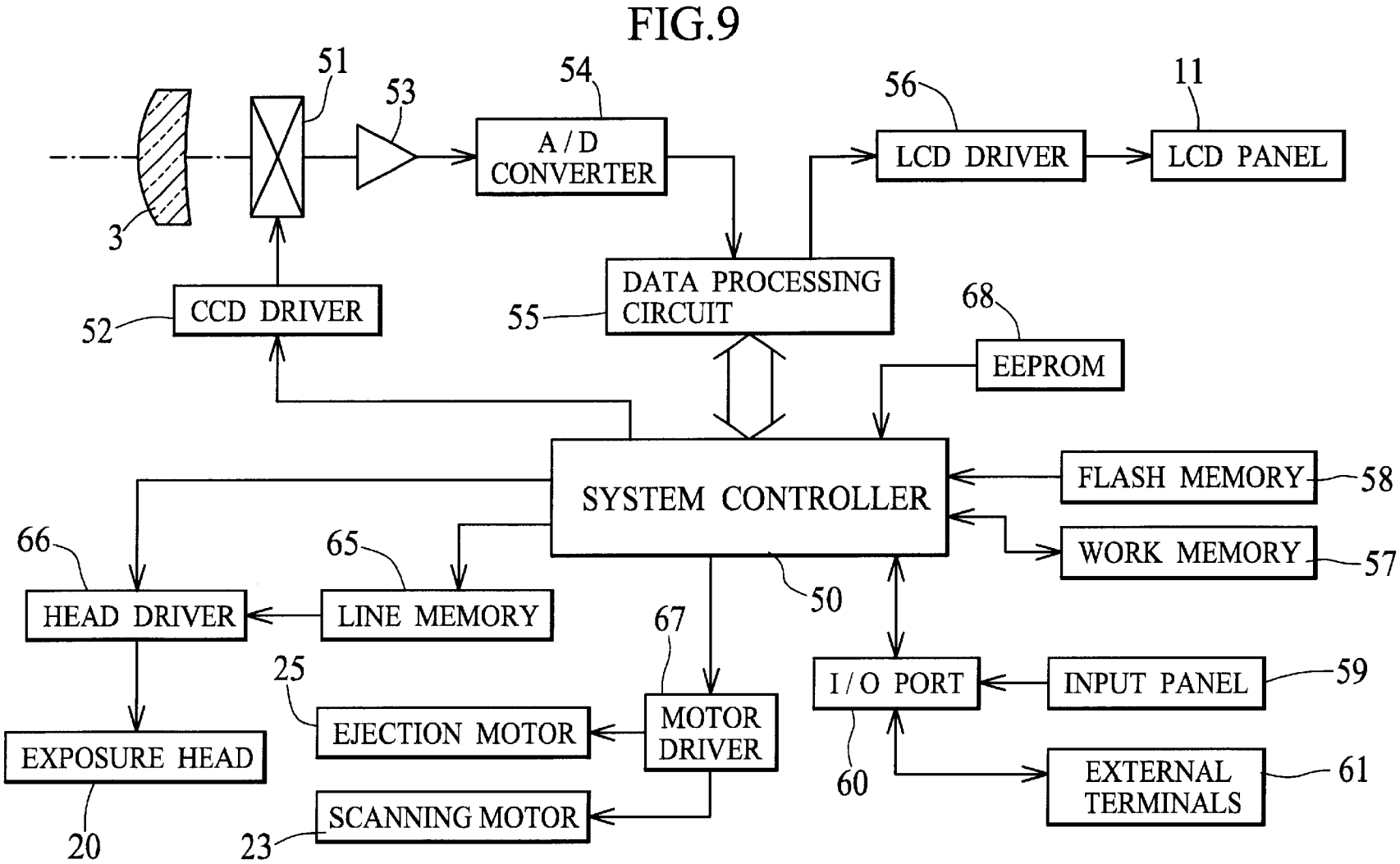
FIG. 9 is a block diagram of circuitry of the electronic still camera.

FIG. 9 shows a circuitry of the above described electronic still camera. The operation of the electronic still camera is controlled by a controller 50, which is made up of CPU, ROM, RAM and so on. The controller 50 controls sequential operations necessary for imaging and printing in accordance with a sequential programs written in ROM. RAM is used as a work memory to store necessary data temporarily.

Behind the taking lens 3 is disposed a CCD image sensor 51 having a photo receiving area on which an optical subject image is focused through the taking lens 3. A CCD driver 52 drives the CCD image sensor 51 to convert optical subject image into electrical image signal, and send it to an amplifier 53.

Charge-store time of the CCD image sensor 51 is controlled automatically in accordance with subject brightness measured by the photo sensor. The charge-store time may be automatically controlled in accordance with a feedback signal from the amplifier 53. In addition, the taking lens 3 is a pan-focus type with no focusing operation, but it may be possible to put an auto-focusing mechanism to measure subject distance, or to carry out focusing operation manually.

Microscopic color filters of red, green and blue are arranged at a regular interval over a photo receiving surface of the CCD image sensor 51, so image signals of red, green and blue are obtained serially. These image signals are amplified to a proper level by the amplifier 53, and converted into a digital form through an A/D converter 54. These digitalized image data of three color is sent to a data processing circuit 55.

The data processing circuit 55 makes kinds of data processing steps including white-balance control, gamma-correction, and matrix operation. In the taking mode, image data of one frame is successively sent from the A/D converter 54 to the data processing circuit 55, in which necessary data processing is carried out. Then, image data is sent to an LCD driver 56, so that the LCD panel 11 displays moving subject images.

When the shutter release button 5 is operated, image data of one frame obtained at that moment is written in a work memory 57 through the system controller 50, and then stored in a flash memory 58. If the memory card are chosen, image data of still image is stored in the memory card loaded in the memory slot. In a taking-and-printing mode, print operation is carried out by use of image data read from the work memory 57.

In reproducing an image, image data of one frame is read from the flash memory 58 or the memory card, and stored in the work memory 57. Then, image data is sent to the LCD driver 56 from the work memory 57, so the image is displayed in the LCD panel 11. By making a print command in that reproducing state, image data sent from the work memory 57 is used for print operation.

An input unit 59 includes the shutter release button 5, the console panel 12 and so on, and input signal from the input unit 59 is sent to the system controller 50 through the I/O port 60. The system controller 50 carries out kinds of operations in accordance with the input signal. An external terminals 61 includes the memory slot, kinds of connectors for connecting the camera to an external computer or the like. Image data and other necessary data is exchanged between the system controller 50 and the memory card or external computers through the external terminals 61.

The printing device includes the exposure head 20, the scanning motor 23, the ejection motor 25, a line memory 65, a head driver 66, a motor driver 67 and soon. In print operation, image data of three color of one line is sent from the work memory 57, and written in the line memory 65. The head driver 66 drives the exposure head 20 in accordance with image data stored in the line memory 65. At that time, the head driver 66 controls light emitting times of respective organic light emission elements 40*a* to 42*a* in accordance with gradation of image data.

The scanning motor 23 and the ejection motor 25 are driven by the motor driver 67. When the motor driver 67 drives the scanning motor 23 to rotate, the exposure head 20 moves in the sub scan direction S, as described above. The spread roller set 24 and the claw member 16 are driven by the ejection motor 25. The claw member 16 is reciprocated one time just after exposure is completed.

An EEPROM 68 is connected to the system controller 50. The EEPROM 68 previously stores various kinds of adjustment data that are referred to by the system controller 50 when the electronic still camera is operated according to a predetermined sequence. The adjustment data includes correction data of respective colors used in printing operation, for instance, and is written in the inspection process after manufacturing the electronic still camera.

Next, the operation of the electronic still camera will be described. By operating the console panel 12, the main switch is turned on and the electronic still camera is powered. Then, the system controller 50 sets the present mode between the taking mode or the reproduction mode, depending upon a set position of the console panel 12. These operation mode can be changed by operating the console panel 12. In taking mode, the taking-and-printing mode may be chosen, if necessary.

In taking mode, The CCD image sensor 42 continuously photographs subject images, and the images are converted into the image data, which is sent to the data processing circuit 55. The processed image data is sent to the LCD driver 56, and the images are displayed as moving images on the LCD panel 11.

Upon depressing the shutter release button 5 after framing by use of the LCD panel 11, image data of a subject image displayed at that moment on the LCD panel 11 is written in the work memory 57, and then written in the flash memory 58. When the memory card is selected, image data is written in the memory card. In taking-and-printing mode is chosen, print operation is carried out just after image data is stored.

In reproduction mode, an appropriate image is selected among those stored in the flash memory 58 or the memory card by operating the console panel 12, and display the image in the LCD panel 11. Then, by making a print command from the console panel 12, image data of the displayed image is read out from the work memory 57 to carry out print operation.

The system controller 50 detects the position of the exposure head 20 by use of a photo sensor (not shown). When the exposure head 20 is located at the print start position, the system controller 50 reads image data of three colors of the first line from the work memory 57, and sends it to the head driver 66 through the line memory 65. The system controller 50 controls the head driver 66 to drive the organic light emission element arrays 40 to 42. Thereby, organic light emission elements for red 40*a* emanate red recording light beams for a certain time in accordance with the gradation of corresponding red image data of the first line. The organic light emission elements for green and blue 41*a* and 42*a* also emanate green and blue recording lights in accordance with image data of green and blue of the first line.

Red recording light beams from the light emission array for red 40 enter the focusing lens array 31 through lens array for red 43. Then the red light beams are reflected by the mirror 33, and applied to the exposure surface 6*a* of the instant photo film 6. Green recording light beams are focused on the instant photo film 6 through the lens array for green 44*a,* the optical fiber 31*a* and the mirror 31. Blue recording light beams are also focused on the instant photo film 6 through lens array for blue 45*a,* the optical fiber 31*a* and the mirror 31. Thereby, the print image of red, green and blue of the first line is recorded onto the instant photo film 6.

Three color recording light beams from the light emission elements 40*a* to 42*a* are condensed by the condenser lenses 43*a* to 45*a* placed close to the light emission elements 40*a* to 42*a,* so utilization of recording light beams can be performed. Moreover, these condenser lenses 43*a* to 45*a* are determined their radii of curvature in accordance with the wavelengths of corresponding light beams, so recording light beams of three colors are focused on the instant film 6 without causing axial chromatic aberration.

After exposure of the first line, the scanning motor 23 is rotated to move the exposure head 20 in the sub scan direction S by one line toward the print end position. During the conveyance of the exposure head 20, the system controller 50 reads image data of three color of the second line, and sends it to head driver 66 through the line memory 65. When the exposure head is moved to the position to record the second line, the system controller 50 controls the head driver 66 to drive the organic light emission element arrays 40 to 42, to apply recording light beams of red, green and blue of the second line onto the instant photo film 6, in the same way as above. Afterwards, moving the exposure head 20 in the sub scan direction line by line, the full-color image is exposed to the instant film 6.

When exposure of the last line is completed, the system controller 50 moves the exposure head 20 to the initial position. When the exposure head 20 begins moving toward the initial position, the system controller 50 rotates the ejection motor 25 through the motor driver 67. Then, the claw member 16 enters the pack case 15 through the cutout 15*b,* to thrust the exposed instant film 6 out of the film pack 14. At that time, the system controller 50 rotates the spread roller set 24. When one end of the instant photo film 6 is nipped by the spread roller set 24, the instant photo film 6 is fed by the spread roller set 24 toward the ejection slit 8. Thereafter, the claw member 16 is retracted from the pack case 15, and moves back to the print start position for succeeding print operation.

While the instant photo film 6 is fed by the spread roller set 24, the processing fluid pod 6*a* is ruptured, so the processing fluid is spread over the whole recording area 6*c* of the instant photo film 6. In one or several minutes after ejection, the exposed image is transferred to the image receiving sheet as the positive image, so the image, displayed in the LCD panel 11 at the time when the print command is produced or photographed through the taking lens 3, is printed as a print picture. Because of correction of axial chromatic aberration by use of these lenses 43*a* to 45*a,* it is possible to obtain a print picture of high quality with no definition in color.

Moreover, recording light beams from the light emission elements 40*a* to 42*a* are utilized by use of the lenses 43*a* to 45*a,* an exposure can be carried out with low electric power. So it is possible to save electricity of the battery.

Figure 10:
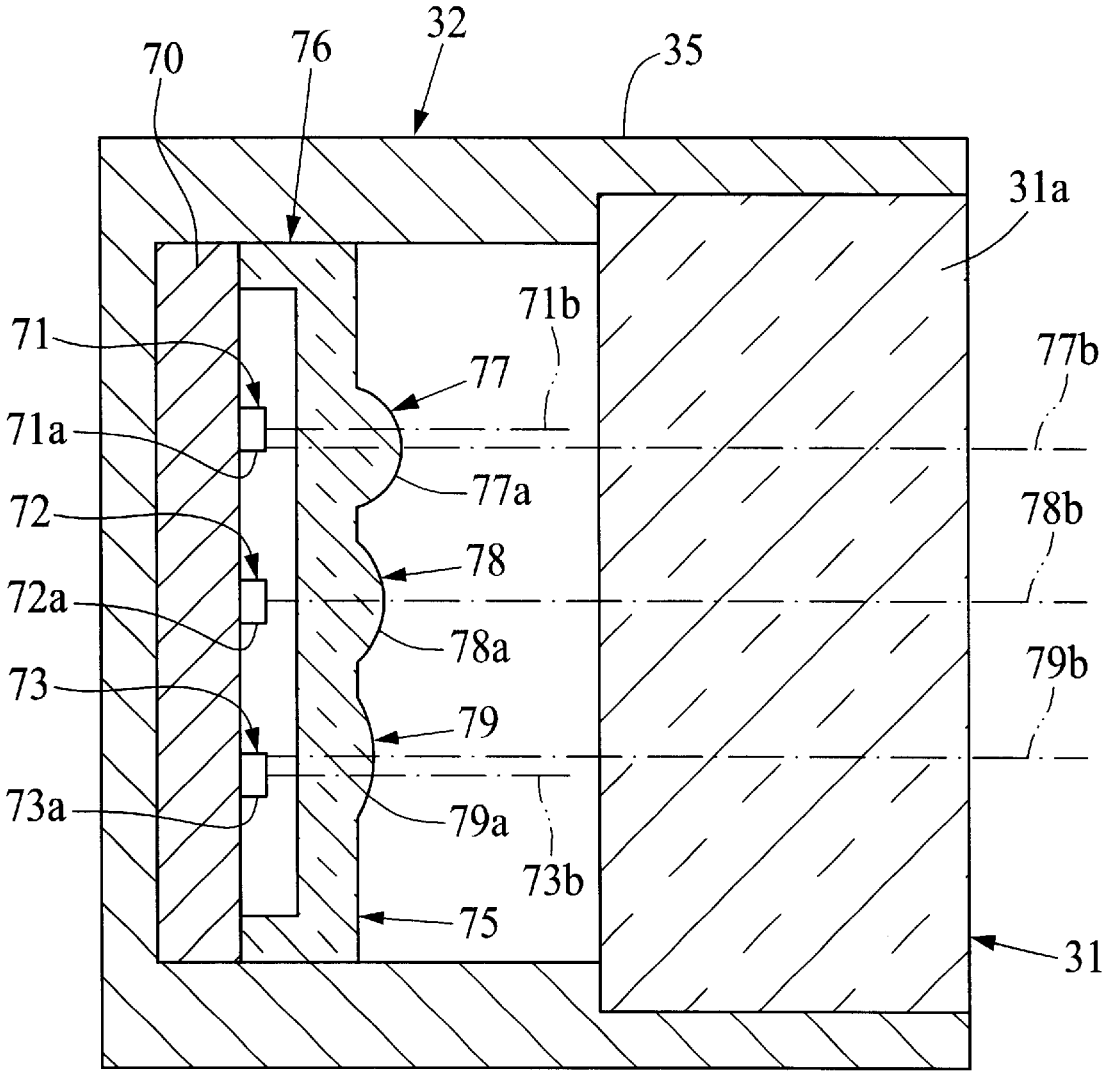
FIG. 10 is a sectional view of another example of the light emission unit.

FIG. 10 shows an example of using LED elements instead of organic light emission elements. Similar elements to those shown in the above embodiments are designated by the same reference numbers as used in the above embodiments, so detailed description about these elements is omitted.

A light emission array unit 76 is comprised of a substrate 70, LED element arrays for red, green and blue 71, 72 and 73, and a cover plate 75. Each of the LED element arrays 71 to 73 is formed on the substrate 70. In order to protect the emission surface of the LED element arrays 71 to 73 from a dust or flaw, the substrate 70 is covered with a transparent cover plate 75.

The LED element array for red 71 includes a plurality of red LED elements 71*a* for emanating red recording light beams arranged in line parallel to the main scan direction M. The LED element arrays for green and blue 72 and 73 includes a plurality of green LED elements 72*a* and the blue LED elements 73*a,* which are also arranged in line parallel to the main scan direction M. The cover plate 75 has lens arrays for red, green and blue 77, 78 and 79, each of which includes a plurality of condenser lenses 77*a* to 79*a* arranged in line. Each of the condenser lenses is confronted with each of the LED elements 73*a* to 75*a*.

The condenser lens for green 78*a* is located such that its optical axis 78*b* is coincident with the optical axis of the green LED element 72*a*. On the other hand, the condenser lenses for red and blue 77*a* and 79*a*, which are arranged above and below the condenser lens for green 78*a*, are located such that their optical axes 77*b* and 79*b* are not coincident with optical axes of corresponding LED elements 71*b* and 73*b*, but they are slightly shifted toward the optical axis for green 78*b*. Blue and red recording light beams from the LED elements 71*a* and 73*a* are inclined toward the optical axis for green 78*b*, so that three color recording light beams of one pixel are focused on the same position of the instant photo film 6 through the focusing lens array 31. These lens arrays 77 to 79 have the same configurations as that described in the first embodiment.

In using LED elements as light emission source, integrating lens arrays 77 to 79 into the cover plate 75 for protection makes it possible to dispose the lens arrays close to the light emission surface. In that case, respective lenses 77*a* to 79*a* may have different radii of curvature according to the wavelength of recording light beam, thereby it is possible to correct axial chromatic aberration.

In the above embodiments, three recording light beams of red, green and blue are focused on the same line of the instant photo film 6, but these recording light beams may be focused on different lines of the instant photo film 6. In that case, the distance between light emission element arrays is set to be the same as that between lens arrays. In these embodiments, recording light beams of red, green and blue are applied onto the instant photo film 6 simultaneously, but it is possible to record one color image while scanning the exposure head 20 by one time. In order to record full-color image, the exposure head 20 is scanned in the sub scan direction S by several times. Moreover, the exposure head 20 may be fixed. In that case, the exposure head 20 is driven in synchronous to the ejection of the instant photo film 6, to which recording light beams of three color are applied.

In the above embodiments, the printing device is incorporated in the electronic still camera, but it is possible to separate the printing device from the electronic still camera. In addition, the light emission array unit of the present invention is also applicable to the color printer for recording an image onto a recording material other than the instant film. Furthermore, the present invention is not limited to a printing device, but is applicable to a film scanner which scans the developed film to display the image or store the image data electrically converted in the media, for instance.

Thus, the present invention is not to be limited to the above embodiments, but on the contrary, various modifications are possible to those skilled in the art without departing from the scope of claims appended hereto.

What is claimed is:

1. A light emission unit comprising:

a plurality of light emission element arrays for emitting a plurality of linear light beams of different color from a light emitting surface, each of said light emission element arrays having a plurality of light emission elements arranged in line for emitting light beam of same color;

a transparent plate for protecting said light emitting surface of said light emission element arrays; and a plurality of lens arrays arranged on said transparent plate such that each of said lens arrays corresponds to each of said light emission element arrays, respective said lens array including a plurality of condenser lenses, each of which is faced to each of said light emission elements;

wherein the plurality of lens arrays and the transparent plate are respective portions of a single piece of transparent material.

2. The light emission unit of claim 1, wherein each of the light emission elements is separated from a respective said condenser lens by a gap.

3. The light emission unit of claim 1, wherein the transparent plate comprises a plurality of convex portions on a side of the plate opposite the light emission element arrays, each of the convex portions corresponding to one of the light emission elements.

4. A light emission unit as defined in claim 1, wherein a plurality of said light emission element arrays include a light emission element array for red for emitting linear light beam of red, a light emission element array for green for emitting linear light beam of green, and a light emission element array for blue for emitting linear light beam of blue.

5. A light emission unit as defined in claim 4, wherein a radius of curvature of said condenser lens becomes smaller as wavelength of light beam of corresponding said light emission element becomes longer.

6. A light emission unit as defined in claim 5, wherein said light emission element arrays of red, green and blue are arranged in this order listed, and said condenser lenses for red and blue are located such that their optical axes are shifted from optical axes of corresponding light emission elements toward said condenser lens for green.

7. A light emission unit used for printer, said printer exposing an image to a photosensitive material, said light emission unit comprising:

a plurality of light emission element arrays for emitting a plurality of linear light beams of different color from a light emitting surface, each of said light emission element arrays having a plurality of light emission elements arranged in line for emitting light beam of same color;

a transparent plate for protecting said light emitting surface of said light emission element arrays; and a plurality of lens arrays arranged on a first side of said transparent plate such that each of said lens arrays corresponds to each of said light emission element arrays, respective said lens array including a plurality of condenser lenses, each of which is faced to each of said light emission elements;

wherein the plurality of lens arrays and the transparent plate are respective portions of a single piece of transparent material.

8. The light emission unit of claim 7, wherein each of the light emission elements is separated from a respective said condenser lens by a gap.

9. The light emission unit of claim 7, wherein the transparent plate comprises a plurality of convex portions on a side of the plate opposite the light emission element arrays, each of the convex portions corresponding to one of the light emission elements.

10. A light emission unit as defined in claim 7, wherein said condenser lens is a convex lens provided on a side of said photosensitive material.

11. A light emission unit as defined in claim 10, further comprising:

a focusing lens array being disposed between said light emission element arrays and said photosensitive material, said light beams from said light emission element arrays are focused on said photosensitive material through said focusing lens array, said focusing lens array having a plurality of graded-index type optical fibers arranged in line.

12. A light emission unit as defined in claim 11, wherein said light emission element array includes:

a transparent positive electrode;

an organic compound layer stacked on said positive electrode, said organic compound layer including organic light emission elements for emitting said light beams;

a negative electrode stacked on said organic compound layer, said light beam being reflected by said negative electrode toward said positive electrode; and wherein said positive electrode, said organic compound layer and said negative electrode are provided on a second surface of said transparent plate.

13. A light emission unit as defined in claim 12, wherein said organic compound layer includes:

an organic light emission element array for red for emitting linear light beam of red;

an organic light emission element array for green for emitting linear light beam of green; and an organic light emission element array for blue for emitting linear light beam of blue.

14. A light emission unit as defined in claim 13, wherein a radius of curvature of said condenser lens becomes smaller as wavelength of light beam of corresponding said light emission element becomes longer, such that said red, green and blue light beams are focused on said photosensitive material.

15. A light emission unit as defined in claim 14, wherein said light emission element arrays of red, green and blue are arranged in this order listed, and said condenser lenses for red and blue are located such that their optical axes are shifted from optical axes of corresponding light emission elements toward said condenser lens for green.

16. A light emission unit as defined in claim 11, wherein said plural light emission element arrays includes:

a red LED element array for red for emitting linear light beam of red;

a green LED element array for green for emitting linear light beam of green; and a blue LED element array for blue for emitting linear light beam of blue.

17. A light emission unit as defined in claim 16, wherein a radius of curvature of said condenser lens becomes smaller as wavelength of corresponding said light emission element becomes longer, such that said red, green and blue light beams are focused on said photosensitive material.

18. A light emission unit as defined in claim 17, wherein said light emission element arrays of red, green and blue are arranged in this order listed, and said condenser lenses for red and blue are located such that their optical axes are shifted from optical axes of corresponding light emission elements toward said condenser lens for green.

* * * * *